US006108018A

United States Patent [19]

Narita et al.

[11] Patent Number: 6,108,018

[45] Date of Patent: Aug. 22, 2000

[54] RECORDING CHIP, RECORDING HEAD, AND IMAGE RECORDING APPARATUS

[75] Inventors: Izumi Narita, Shizuoka-ken; Kenji Muto, Mishima, both of Japan

[73] Assignee: Canon Kabushiki Kaisha, Tokyo, Japan

[21] Appl. No.: 09/076,459

[22] Filed: May 12, 1998

[30] Foreign Application Priority Data

May 13, 1997 [JP] Japan ..... 9-122030
May 13, 1997 [JP] Japan ..... 9-122258

[51] Int. Cl.[7] ..... B41J 2/45; G03G 15/00

[52] U.S. Cl. ..... 347/132; 345/82; 347/237

[58] Field of Search ..... 347/132, 130, 347/237, 247; 257/88; 345/82; 315/169.1, 169.2

[56] References Cited

U.S. PATENT DOCUMENTS 5,177,405 1/1993 Kusuda et al. ..... 315/169.1

5,814,841 9/1998 Kusuda et al. ..... 257/113

*Primary Examiner*—Joan Pendegrass

*Attorney, Agent, or Firm*—Fitzpatrick, Cella, Harper & Scinto

[57] ABSTRACT

It is an object to provide an image recording apparatus for recording an image of high resolution at a high speed. An electrostatic latent image is recorded onto a photosensitive material by using a recording head which has a plurality of switching elements which are arranged in an array shape and sequentially turn on the adjacent switching elements and light emission element arrays of a plurality of columns each of which is constructed by arranging light emission elements, in an array shape, which are connected to the switching elements and which are arranged in almost parallel, and in which each of the switching elements turns on the corresponding light emission element, so that the plurality of light emission elements are scanned. Developing means develops the electrostatic latent image and transfer means transfers the developed latent image onto a recording paper.

28 Claims, 14 Drawing Sheets

FIG. 6

2202

A0, A1, A2, A3 ····· A127, A128, A129 ····· A255, A256 ·····
B0, B1, B2, B3 ····· B127, B128, B129 ····· B255, B256 ·····
A0, A1, A2, A3 ····· A127, A128, A129 ····· A255, A256 ·····

RECORDING CHIP, RECORDING HEAD, AND IMAGE RECORDING APPARATUS

BACKGROUND OF THE INVENTION

1. Field of the Invention

The invention relates to a light source apparatus regarding an exposure of a photosensitive material and an image recording apparatus of an electrophotographic type.

2. Related Background Art

Hitherto, as an exposing light source to a photosensitive material in an image recording apparatus of an electrophotographic type, a light source using a light emission element array of one column or a light source using a scanner in which a laser diode is used as a light source has been disclosed.

In the apparatus using the light emission element array of one column, since it take time to transfer print data to light emission elements, there is a problem such that a rotational speed of a photosensitive drum has to be set to a low speed. Particularly, such a problem is serious in case of forming an image of high resolution.

SUMMARY OF THE INVENTION

It is, therefore, an object of the invention to provide a light source apparatus and an image recording apparatus which can record at a high speed and with high resolution.

According to the invention, there is provided a recording chip comprising:

light emission element arrays of a plurality of columns which are arranged in almost parallel; and scanning means for scanning recording elements in the light emission element arrays, wherein the light emission element arrays and the scanning means are provided in the chip, and a recording operation is executed in accordance with image data which is serially inputted.

According to the invention, there is also provided a recording head comprising recording chips which are arranged in an array, wherein recording element arrays of a plurality of columns which are arranged in almost parallel and scanning means for scanning recording elements in the recording element arrays are provided in the chip, and the recording chip executes a recording operation in accordance with image data which is serially inputted.

According to the invention, there is also provided an image recording apparatus for recording an image onto a recording medium by using a recording chip which comprises therein light emission element arrays of a plurality of columns that are arranged in almost parallel and scanning means for scanning recording elements in the light emission element arrays and which executes a recording operation in accordance with image data which is serially inputted.

The above and other objects and features of the present invention will become apparent from the following detailed description and the appended claims with reference to the accompanying drawings.

BRIEF DESCRIPTION OF THE DRAWINGS

FIG. 6 is an explanatory diagram showing a state of image data stored in a buffer;

DETAILED DESCRIPTION OF THE PREFERRED EMBODIMENTS (First embodiment)

An embodiment of the invention will be described in detail hereinbelow with reference to the drawings.

First, an outline of a whole construction will be described with reference to FIGS. 1 to 4.

Figure 1:
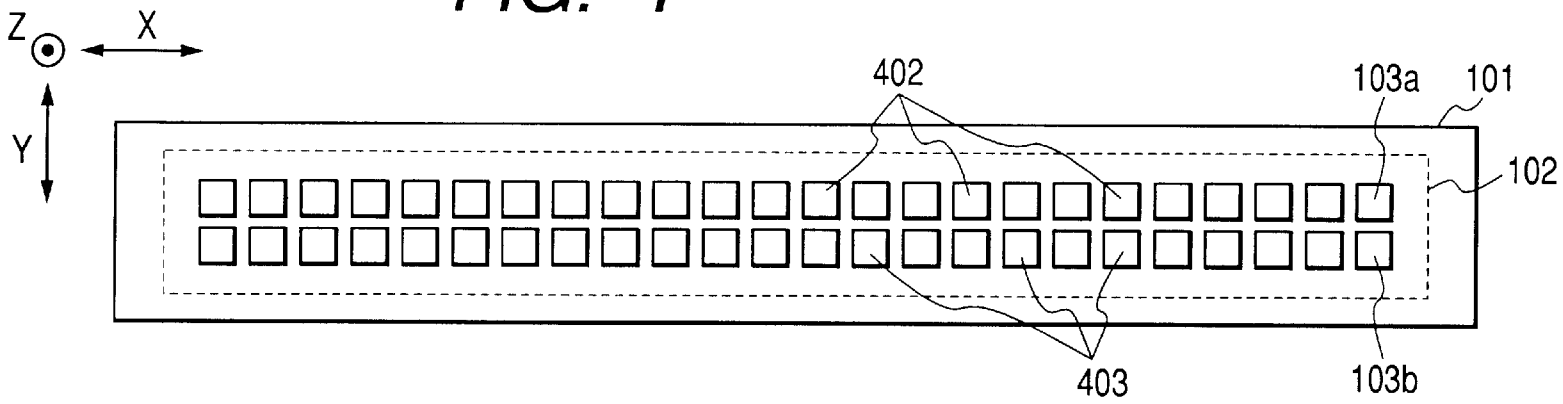
FIG. 1 is a plan view showing a structure of a self-scanning recording element array according to the first embodiment of the invention.
Figure 2:
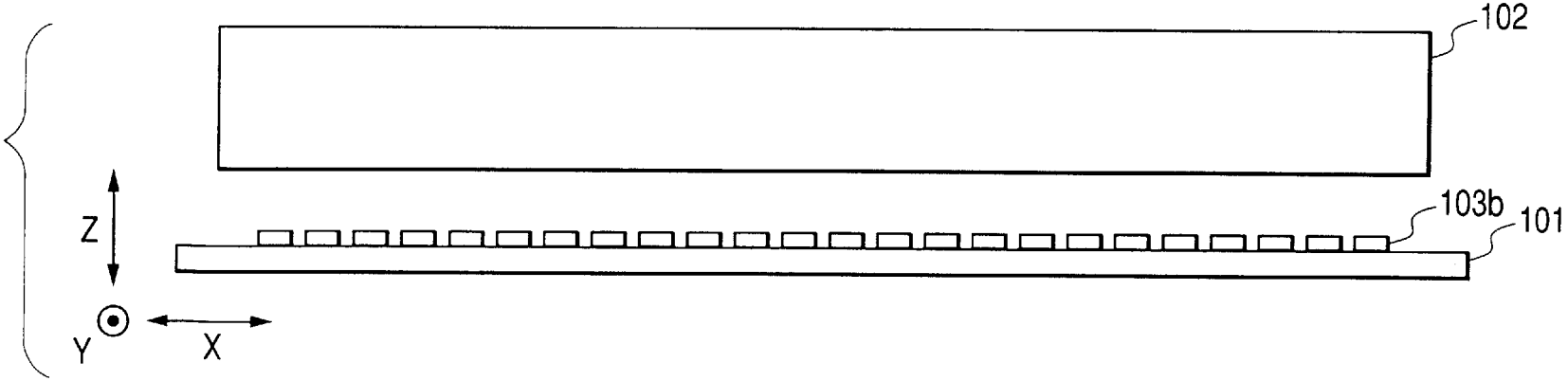
FIG. 2 is a side elevational view showing a structure of the self-scanning recording element array.

FIGS. 1 and 2 are diagrams showing a construction of a print head of the embodiment and are external views which are seen from the direction of a Z axis and the direction of a Y axis, respectively. Reference numeral 101 denotes a board on which light emission units 103*a* and 103*b* are mounted; 102 a rod lens array serving as image forming means; and 103*a* and 103*b* the light emission units in a self-scanning recording element array chip, which will be explained hereinlater. The light emission units 103*a* and 103*b* are constructed in a manner such that a plurality of light emission elements 402 and 403 serving as recording elements are arranged on straight lines (X direction) mutually in parallel along two columns.

Figure 3:
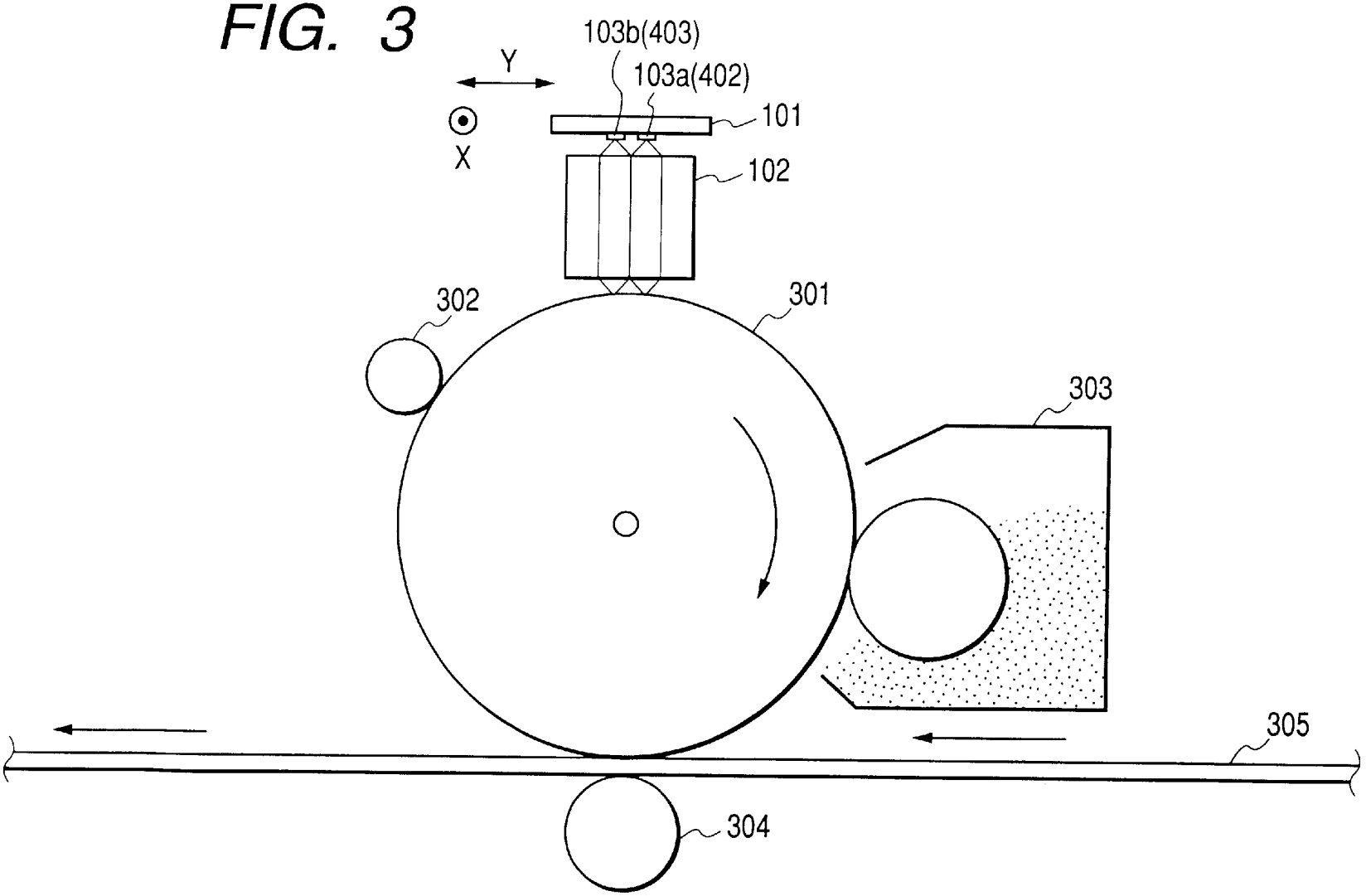
FIG. 3 is a front view showing a construction of a recording unit in a recording apparatus of an electrophotographic type.

FIG. 3 shows a construction of a recording unit in an image recording apparatus of an electrophotographic type having an above light source apparatus. Reference numeral

301 denotes a photosensitive material; 302 a charging roller; 303 a developing device; 304 a transfer roller; and 305 a recording paper.

In FIG. 3, the photosensitive material 301 rotates in the direction shown by an arrow in the diagram. After the surface of the photosensitive material 301 was first uniformly charged by the charging roller 302, it is exposed in accordance with an image to be recorded by a print head constructed by the light emission units 103*a* and 103*b*, rod lens array 102, and the like as will be explained hereinlater. An electrostatic latent image is formed on the surface. The electrostatic latent image on the photosensitive material 301 is visualized by the developing device 303, so that a toner image is formed. The toner image is transferred by the transfer roller 304 onto the recording paper 305 which is conveyed in the direction of an arrow, so that a desired image is formed on the recording paper 305.

The construction of FIG. 3 is common in all of the following embodiments.

A construction of a control unit of the light emission elements 402 and 403 will now be described.

The light emission units 103*a* and 103*b* comprising the light emission elements 402 and 403 and the like, rod lens array 102, a drive unit to which the light emission elements 402 and 403 are connected, and the like are mounted on a print head. The drive unit is controlled by print head control means.

Figure 5:
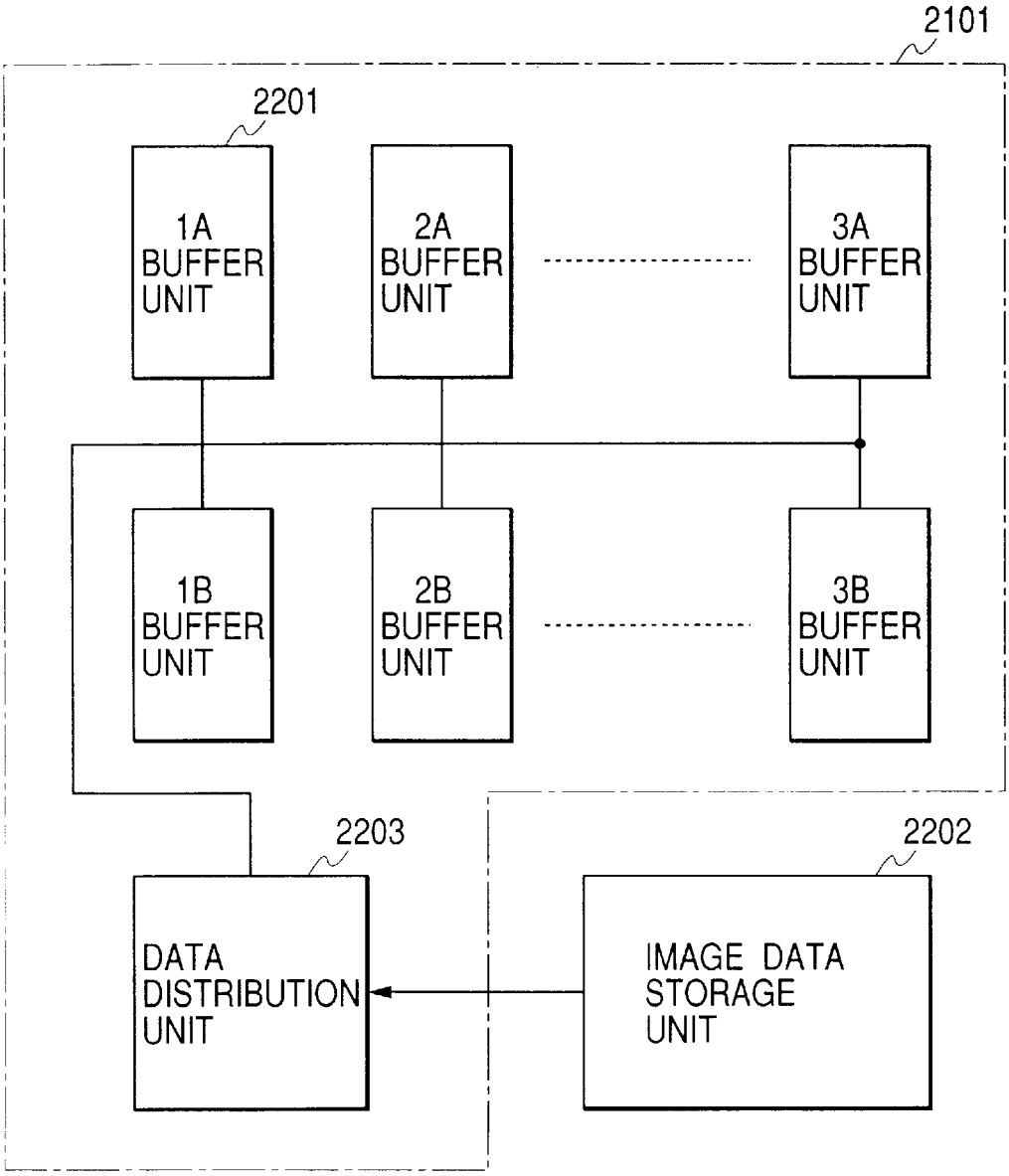
FIG. 5 is a block diagram showing a construction of a control unit of a self-scanning recording element array chip.
Figure 7:
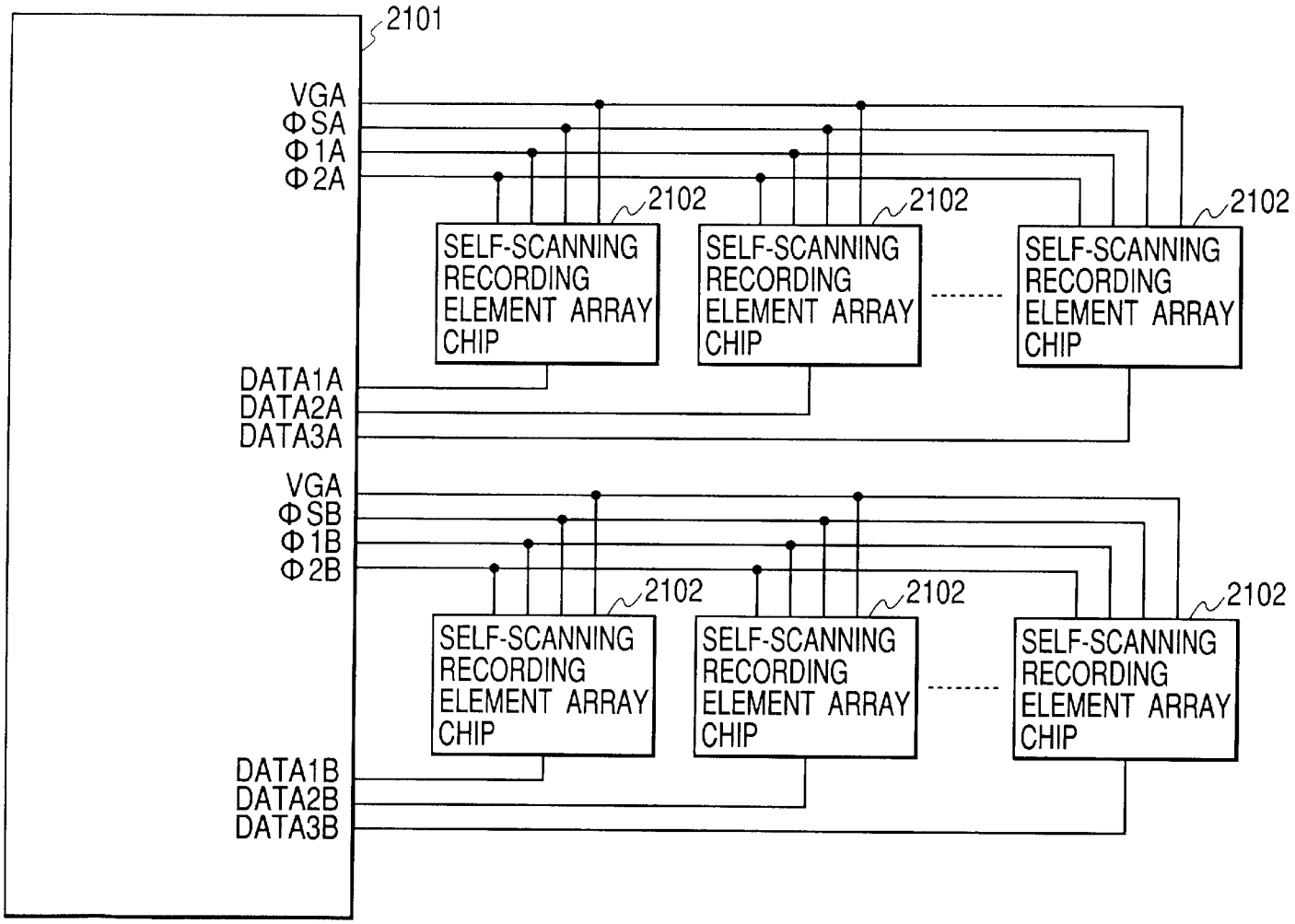
FIG. 7 is a block diagram showing a construction of a self-scanning recording element array chip connected to a control unit.
Figure 9:
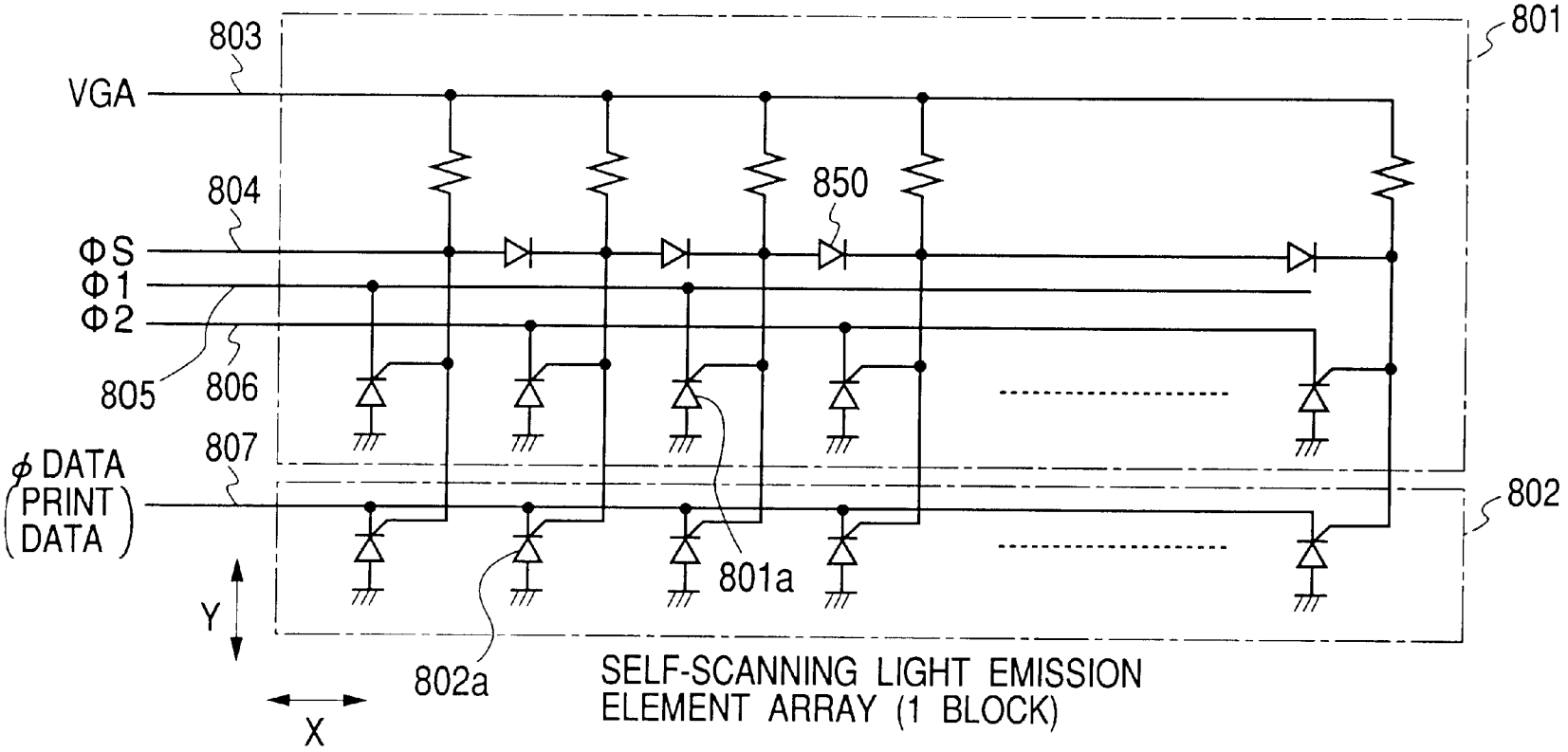
FIG. 9 is a circuit diagram showing a structure of light emission elements of the self-scanning thyristor structure.

FIGS. 5 and 7 show a construction of a control unit of a self-scanning recording element array chip 2102 in FIG. 9. Reference numeral 2101 denotes a driver unit and a buffer unit of the self-scanning recording element array; 2201 in the block 2101 indicates a buffer unit corresponding to each self-scanning recording element array chip 2102; 2202 an image data storage unit; and 2203 a data distribution unit.

FIG. 6 shows image data stored in the image data storage unit 2202. A0 to A127 denote print data to be printed by the first self-scanning recording element array chip 2102 of the first column. A128 to A255 indicate image data to be printed by the second self-scanning recording element array chip 2102 of the first column. B0 to B127 denote print data to be printed by the first self-scanning recording element array chip 2102 of the second column. In the data distribution unit 2203, the print data is distributed into the buffer unit 2201 corresponding to each self-scanning recording element array chip 2102 and a necessary clock is transferred and applied to each self-scanning recording element array chip 2102 together with the foregoing print data clock, thereby enabling light to be emitted.

Figure 4:
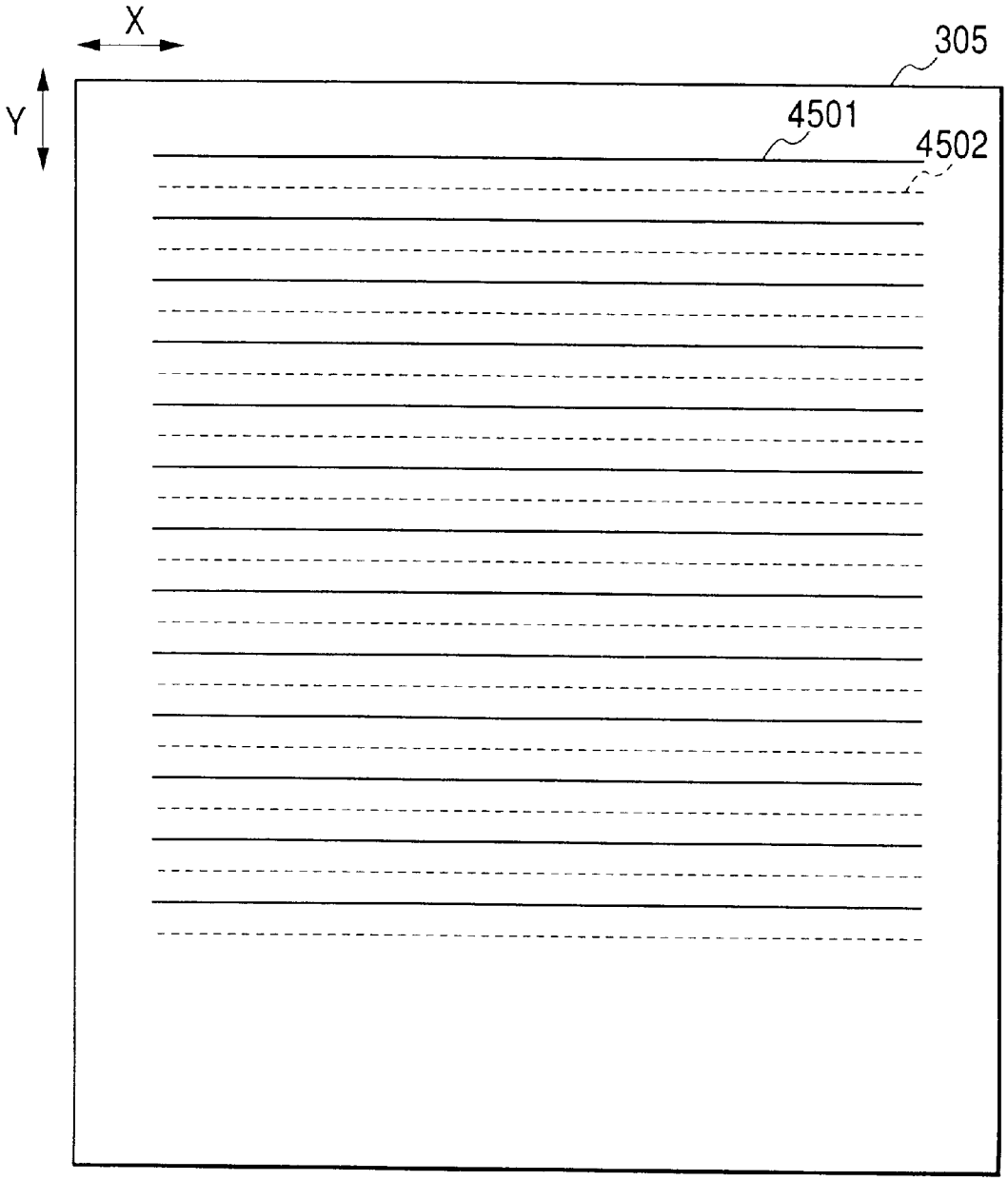
FIG. 4 is an explanatory diagram showing a state in which data has been recorded onto a paper surface by using light emission elements.

The operation will now be described. First, after image data was formed by a host computer or the like, the image data is sent to an image recording apparatus. The image data is inputted to print head control means through interface means. A data conversion to simultaneously perform the recording of a plurality of columns is executed by the light emission elements 402 and 403 of a plurality of columns as shown in FIG. 4 and the data is sent to each drive unit of the light emission elements 402 and 403. Thus, the light emission elements 402 and 403 of a plurality of columns mounted on the board 101 in FIG. 1 in the sub-scanning direction sequentially execute the exposing operations on the basis of predetermined data, thereby forming a latent image onto the photosensitive material 301 which faces those elements.

FIG. 4 shows a state in which an image has been recorded on the recording paper 305 by using the light emission elements 402 and 403 of the invention. In FIG. 4, reference numerals 4501 and 4502 denote recording patterns recorded by the different light emission arrays, respectively.

That is, a line shown by the pattern (solid line) 4501 and a line shown by the pattern (broken line) 4502 which are shown in FIG. 4 construct one set and are simultaneously recorded in the embodiment. The light which was sequentially emitted by the light emission elements 402 and 403 executes the exposing operations onto the photosensitive material 301 through the rod lens array 102 as shown in FIG. 3. After that, a desired image is obtained on the transfer paper 305 by the foregoing electrophotographic process.

By repeating the recording operation as mentioned above, a processing speed can be remarkably improved as compared with that of the exposing process by the conventional light emission elements of a single line.

Figure 8:
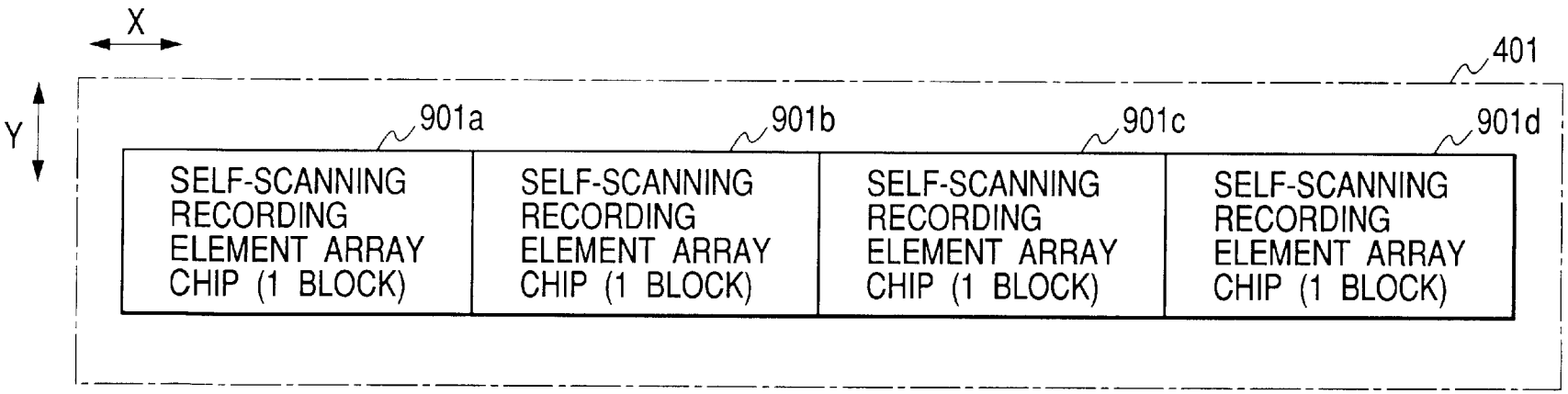
FIG. 8 is a block diagram showing an example in which light emission elements of a self-scanning thyristor structure of a plurality of blocks are mounted on a print head.

A chip on which a plurality of columns each comprising a plurality of light emission elements 402 and 403 mentioned in FIG. 1 are mounted will now be described with reference to FIG. 8. For example, two columns each comprising about 64 to 128 light emission elements 402 and 403 are mounted on the chip per plate (one block). Such single chips as many as a plurality of blocks are mounted in an array shape. That is, by mounting a plurality of single chips in an array shape in accordance with a paper width (X direction) of the image recording apparatus, a print head 401 of a necessary width is realized.

The self-scanning recording element array chip as a recording chip which is used in the invention will now be described. The light emission elements 402 and 403 comprising a plurality of columns (two columns here) on the chip of one block are constructed on a wafer. In correspondence to each of the light emission elements 402 and 403, drivers to drive them are also installed on the print head 401 and are connected to those chips, respectively (not shown). The boards having the light emission elements 402 and 403 of a plurality of columns is collectively formed in a print head shape, thereby enabling a structure as shown in FIG. 1 to be realized. The exposing operation and the image recording operation which are executed by using the print head are as mentioned above.

In this manner, at the wafer stage of forming the recording chip, by installing the light emission elements 402 and 403 of a plurality of columns in almost parallel in an array shape, the processing speed can be improved and the installing process can be efficiently executed in a manner similar to the foregoing example as compared with those of the exposing process by the conventional light emission elements of a single line.

FIG. 9 shows an equivalent circuit construction of the self-scanning recording element array corresponding to one column. The light emission elements comprise light emission thyristors. Reference numeral 801 denotes a shift register unit of a thyristor 801*a*. Reference numeral 802 denotes a light emission unit constructed by the thyristors 802*a* and the like. Each of the thyristors 802*a* corresponds to the foregoing light emission element 103*a*. Reference numeral 803 denotes a VGA to supply a power source; 804 a start signal; 805 and 806 transfer clocks $\phi 1$ and $\phi 2$; and 807 a print data clock ΦDATA. Reference numerals 901*a* to 901*d* in FIG. 8 denote the foregoing self-scanning recording element array chips constructed by mounting a plurality of (four blocks here) of light emission elements of the thyristor structure of FIG. 9 onto the print head 401.

As for the light emission elements of the self-scanning thyristor structure shown in FIG. 9, usually, about 64 to 128 light emission units 802 are mounted per block and a plurality of columns (two columns here) of the light emission elements of one block are formed on the same wafer. As mentioned above, the light emission elements (refer to FIG. 9) on the same wafer are constructed as one block. Those blocks are mounted on the board in an array shape by only the necessary length as shown in FIG. 8, thereby forming the print head 401.

The light emission elements of such a self-scanning thyristor structure as mentioned above can be sequentially turned on by each of the start signal (ϕS) 804, transfer clocks 805 (ϕ1) and 806 (ϕ2), print data clock (ΦDATA) 807, and the like.

The specific operation will now be described. Now, assuming that the thyristor 801*a* is turned on by the transfer clock (ϕ1) 805, a gate potential is almost equal to zero volt. This potential exerts an influence on the right direction through a diode 850. Since only the elements in the right direction are selectively turned on by the next transfer clock ϕ2, the data can be transferred to the right. By applying the print data (DATA) clock corresponding to the image information simultaneously with the addressing operation, a thyristor 802*a* of the light emission unit 802 emits the light. By repeating the above operation, a predetermined thyristor 802*a* can be controlled so as to emit the light in accordance with the image data.

As mentioned above, at the wafer stage of the recording chip, by forming a plurality of columns of the light emission elements in the sub-scanning direction and mounting, the recording speed can be improved as compared with that in case of the exposing operation by the conventional light emission elements of a single line. Since the light emission elements of the self-scanning thyristor structure can be also easily formed on wafers of a plurality of columns as compared with the conventional structure of the LED type, the installing process can be further efficiently performed.

As described above, according to the invention, since a plurality of columns of the self-scanning recording element arrays comprising a plurality of light emission elements are prepared and the photosensitive material is exposed, the recording can be performed at a higher speed in the electrophotographic process.

Since the recording elements of the light emission thyristor structure are used, a high density wafer installation can be realized, so that the recording can be easily performed at high resolution.

(Second embodiment)

Figure 11:
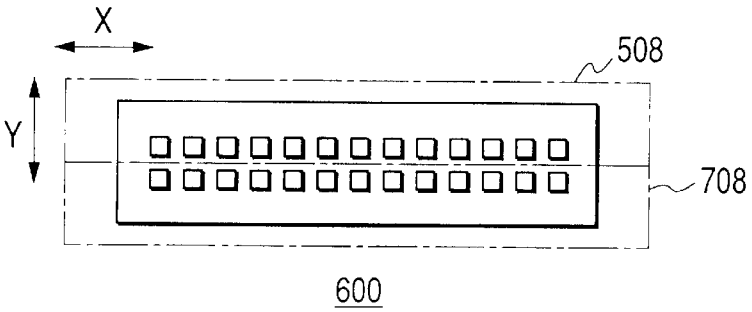
FIG. 11 is a plan view showing a layout of a self-scanning recording element array formed on one chip.

In the following embodiment, as shown in FIG. 11, patterns of the self-scanning recording element arrays as many as two columns are arranged on one semiconductor chip. That is, as shown in FIG. 11, patterns 508 and 708 of two columns are formed on a self-scanning recording element chip 600.

Figure 10A:
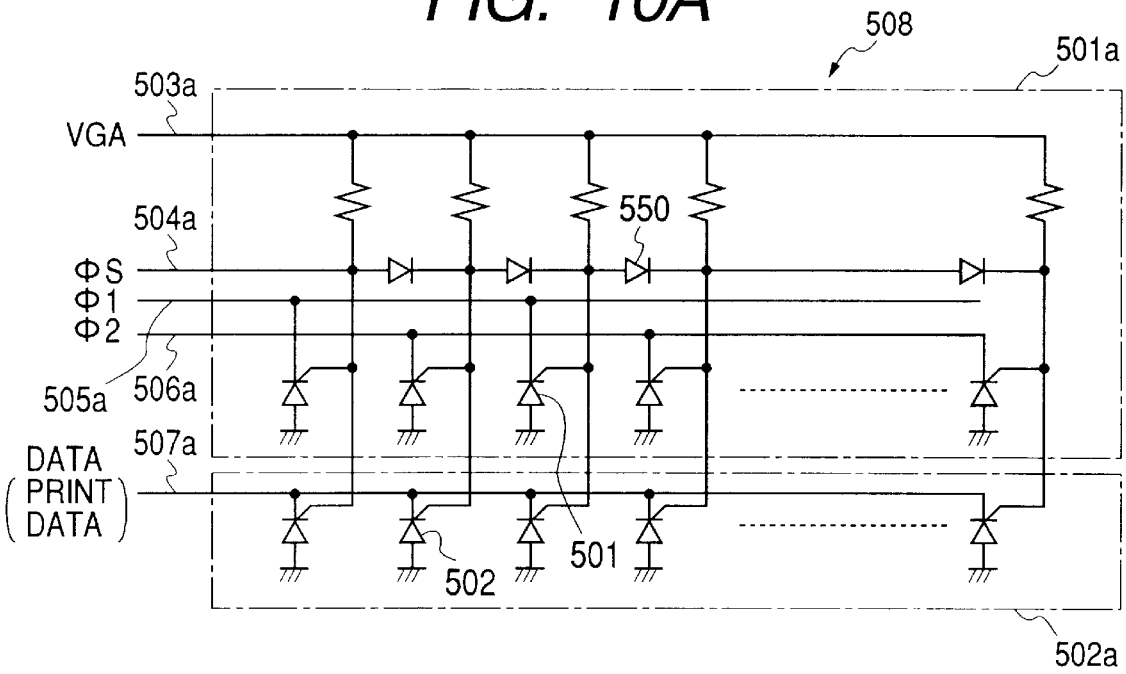
FIGS. 10A and 10B are circuit diagrams each showing a construction corresponding to one block of a pattern in which self-scanning recording element arrays are mutually symmetrically formed.
Figure 10B:
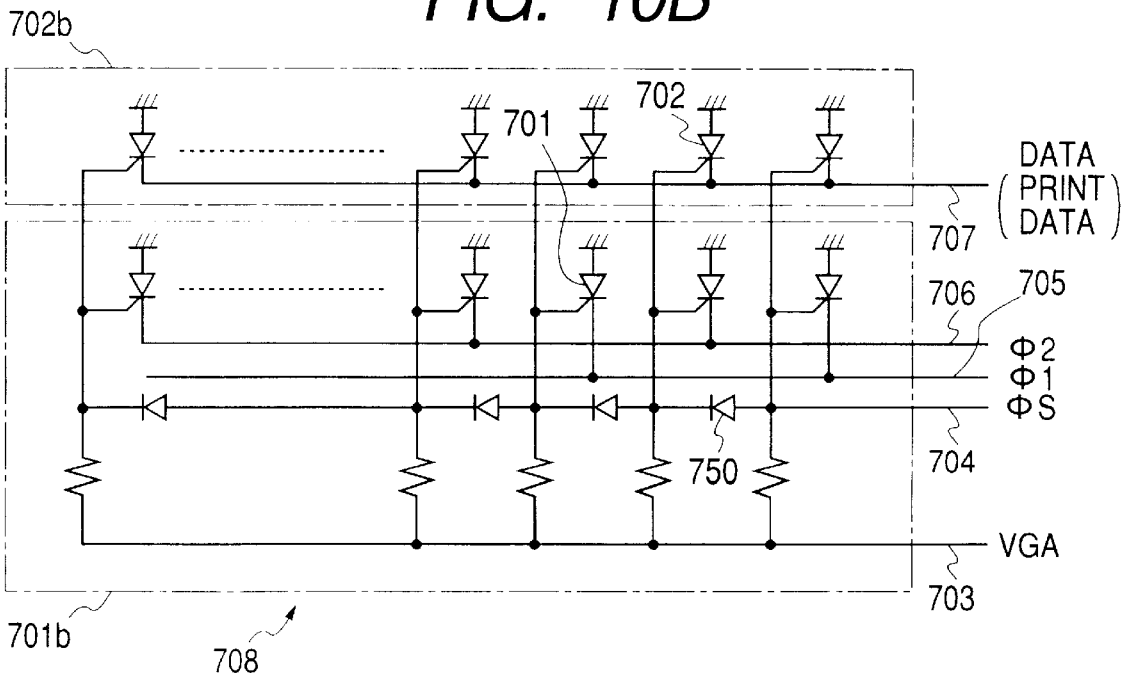

FIGS. 10A and 10B show equivalent circuit constructions of the self-scanning recording element array chip 600 in FIG. 11. Reference numerals 501*a* and 701*b* denote shift register units of thyristors 501 and 701; 502*a* and 702*b* light emission units which are constructed by thyristors 502 and 702 and the like; 503*a* and 703*b* VGAs each for supplying a power source; 504*a* and 704*b* start signals ϕS; 505*a*, 705*b*, 506*a*, and 706*b* denote transfer clocks ϕ1 and ϕ2; and 507*a* and 707*b* print data clocks ΦDATA. In FIG. 11, reference numeral 508 denotes the area including the shift register unit 501*a* and light emission unit 502*a* in FIG. 10 and 708 indicates the area including the shift register unit 701*b* and light emission unit 702*b* in FIGS. 10A and 10B.

The patterns 508 and 708 of the self-scanning recording element array chip are constructed in the same shape and are arranged so that their light emission units adjacently face each other as shown in FIG. 11. Therefore, the patterns of the self-scanning recording element array chip of two columns can be formed on one semiconductor wafer. By arranging a plurality of such patterns in an array shape, the print head can be constructed.

Figure 12:
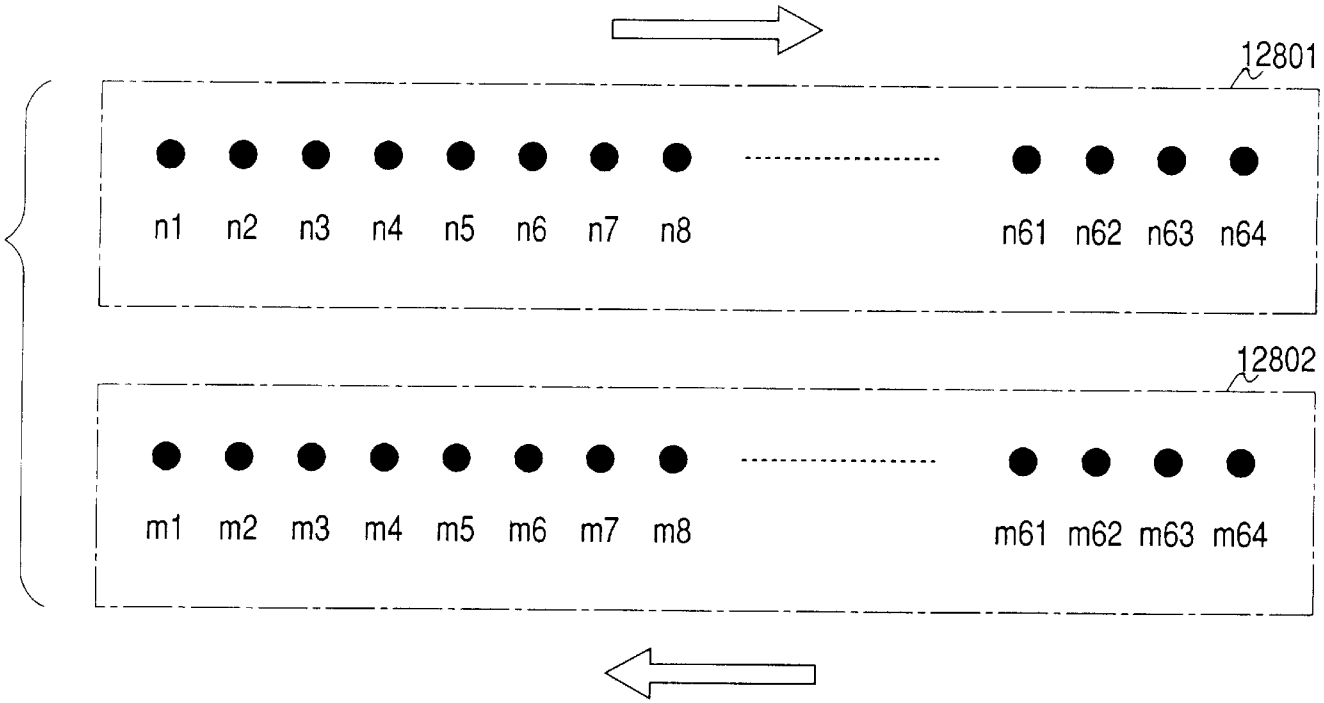
FIG. 12 is an explanatory diagram showing print data to the self-scanning recording element array.

FIG. 12 shows image data which is sent to the print head 401. Reference numeral 12801 denotes image data which is sent to the area 508 in FIG. 11 and 12802 indicates print data which is sent to the area 708 in FIG. 5.

The operation will now be described. After the recording data was first formed by the host computer or the like, it is supplied to the data recording apparatus. The recording data is inputted to the print head control means through the interface means. The data is sent to the drive unit of the light emission elements 402 and 403.

When seeing FIGS. 10A and 10B as an example, in addition to the sent print data, the other signals such as start signals 504*a* and 704*b* and transfer clocks 505*a*, 705*b*, 506*a*, and 706*b* which are necessary to light on the light emission elements (thyristors 502 and 702 of the light emission units 502*a* and 702*b* here) are also formed and are transferred to the areas 508 and 708 of the self-scanning recording element array chip 600 together with the print data clocks 507*a* and 707*b*.

The operation in the self-scanning recording element array chip is similar to that in the first embodiment and each thyristor is allowed to emit the light in accordance with the image data.

As for the data transferring direction in the chip 600, the data is transferred from the left to the right in the upper area 508 and is transferred from the right to the left in the lower area 708 and is sequentially turned on. Thus, the print data is transferred as follows. That is, as shown in FIG. 12, now assuming that there are 64 light emission elements in the chip 600, the data is transferred into the area 508 by the print head control means in accordance with the order of n1, n2, n3, . . . , and n64 as shown in 801. On the other hand, the image data of the relevant recording chip is sequentially inputted to the area 708 from the print head control means in accordance with the order of m64, m63, m62, . . . , and m1 as shown in 802. The image data is also similarly inputted in all of the recording chips on the print head 401. In a manner similar to that mentioned above, as shown in FIG. 3, the light emitted from the light emission elements 402 and 403 sequentially passes through the rod lens array 102 and the exposing operations are executed to the photosensitive material 301. A desired image is formed on the recording paper 305 by the foregoing electrophotographic process.

As mentioned above, by using the print head 401 formed by the wafer chip having the light emission elements of a plurality of columns, the processing speed can be extremely improved and the miniaturization of the apparatus can be realized as compared with the exposure by the conventional light emission elements of a single line.

By forming the self-light emission element arrays in the semiconductor wafer by the patterns which are symmetrical, the apparatus can be easily designed and the reliability can be improved.

Although the control unit in the embodiment is constructed in a manner similar to the first embodiment, the print data is obviously inputted in accordance with the order of the scanning direction of each light emission element array.

(Third embodiment)

Figure 13A:
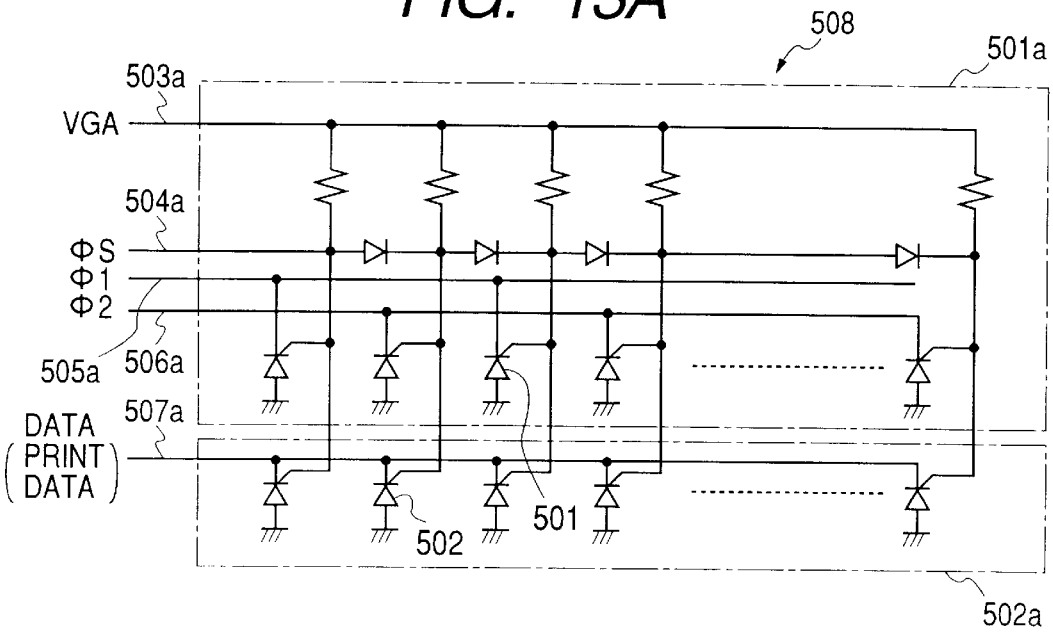
FIGS. 13A and 13B are equivalent circuits of a self-scanning light emission element array chip according to the third embodiment.
Figure 13B:
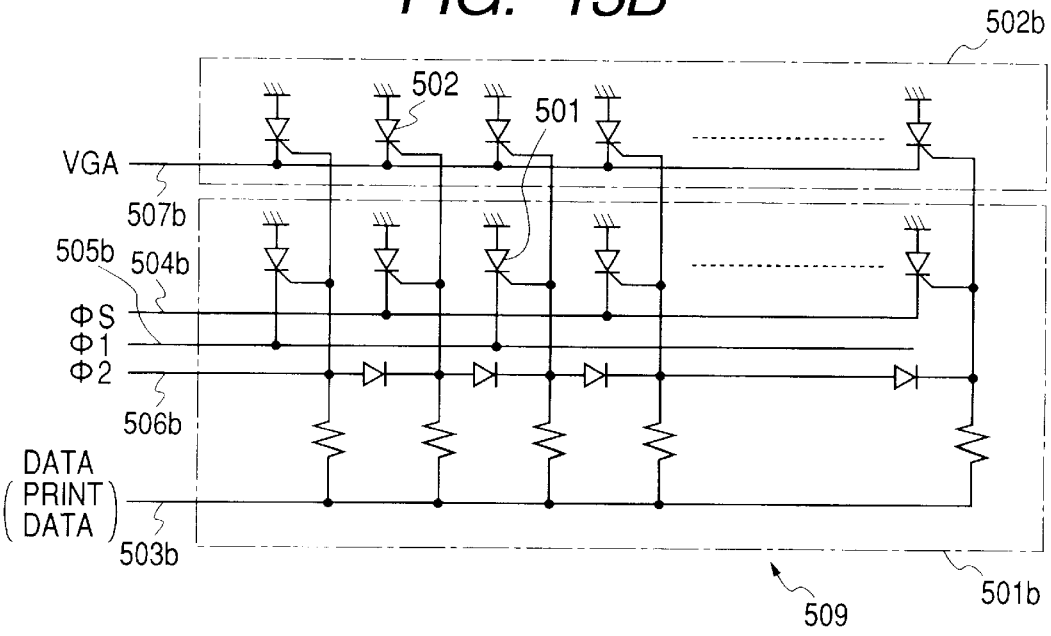

FIGS. 13A and 13B show equivalent circuit constructions of the self-scanning recording element array chip 600. Reference numerals 501*a* and 501*b* denote shift register units of the thyristor 501; 502*a* and 502*b* light emission units of the thyristor 502; 503*a* and 503*b* power sources; 504*a* and 504*b* start signals; 505*a*, 505*b*, 506*a*, and 506*b* transfer clocks; 507*a* and 507*b* print data clocks; 508 the area including the units 501*a* and 502*a*; and 509 the area including the units 501*b* and 502*b*.

That is, the patterns 508 and 509 of the self-scanning recording element array chip are constructed in a shape such that the images are mutually formed. As shown in FIG. 11, by arranging them at positions so that the light emission units adjacently face each other, the patterns of the self-scanning recording element array chips as many as two columns can be formed on one semiconductor chip. By arranging a plurality of such patterns in an array shape, the print head can be constructed.

Figure 14:
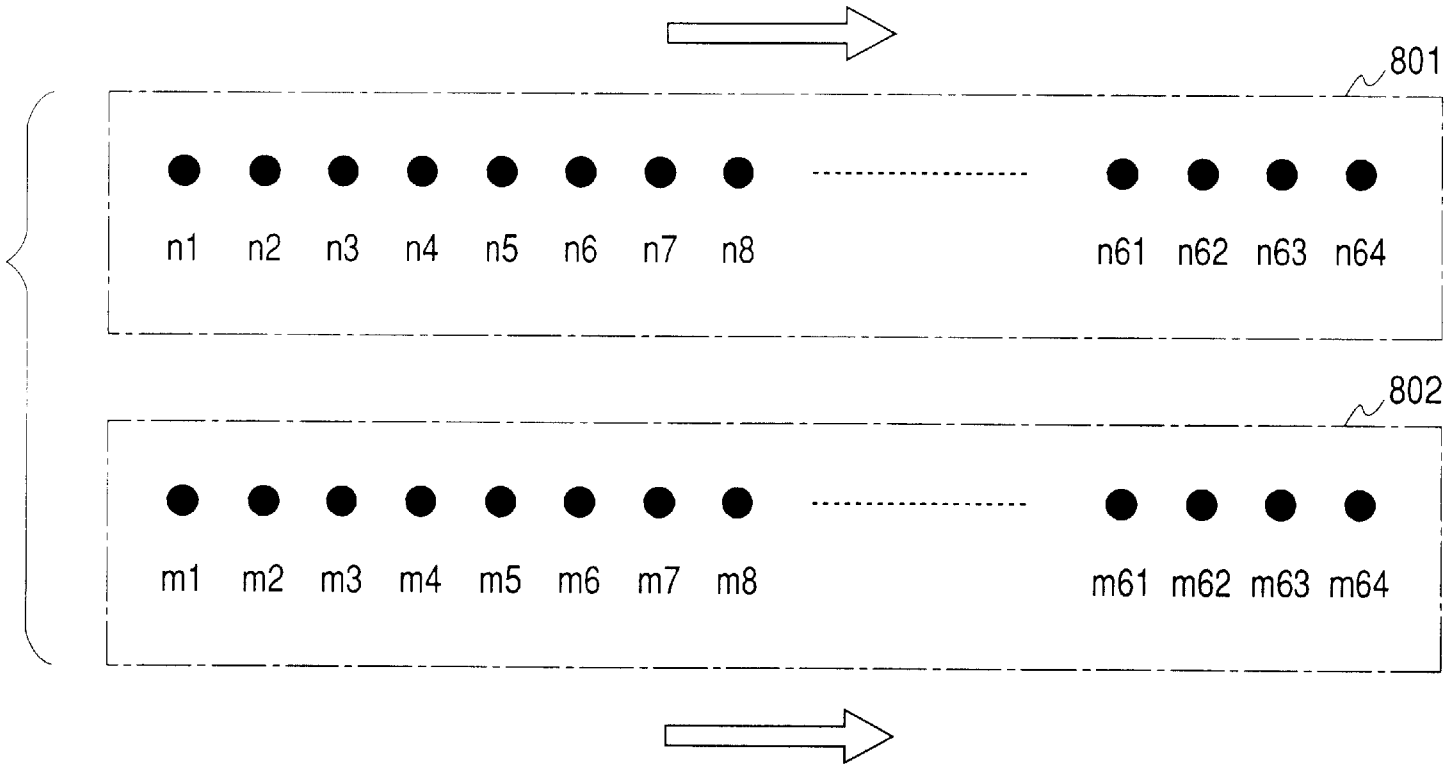
FIG. 14 is an explanatory diagram showing print data of the self-scanning light emission element array in the third embodiment.

The operation of the circuit will now be described. The light emission units 502*a* and 502*b* emit the light in response to the signals which are inputted to the terminals 503*a* to 507*a* and terminals 503*b* to 507*b* in FIGS. 13A and 13B. The signals which are inputted, namely, the start signal ϕS and transfer clocks ϕ1 and ϕ2 can be controlled in a manner almost similar to the foregoing embodiment. However, the control of the print data clock ϕDATA differs. That is, the light emitting order of the light emission elements in the chip 600 in the embodiment is set to the direction from the left to the right in the upper area 508 and to the direction from the right to the left in the lower area 708. Thus, the print data is transferred as follows. That is, as shown in FIG. 14, now assuming that there are 64 light emission elements in the chip 600, the print data is transferred by the print head control means in accordance with the order of n1, n2, n3, . . . , and n64 as shown at 801 in the area 508. The print data is also transferred by the print head control means in accordance with the order of m1, m2, m3, . . . , and m64 as shown at 802 in the area 708. The data is similarly transferred to all of the chips on the print head 401.

After that, as shown in FIG. 3, the light which was sequentially emitted from the light emission elements passes through the rod lens array 102, the exposing operation is executed to the photosensitive material 301, and a desired image is obtained on the recording paper 305 by the foregoing electrophotographic process.

According to the invention as described above, since a plurality of columns of the self-scanning recording element arrays each comprising a plurality of light emission elements are prepared and are used to expose the photosensitive material, the recording can be performed at a higher speed in the electrophotographic process.

By using the recording elements of the light emission thyristor structure, the wafer installation of a high density can be performed, so that the recording can be easily performed at high resolution.

Further, by forming the light emission element arrays by the symmetrical patterns into the semiconductor wafer, the apparatus can be easily designed and the reliability of the parts can be also improved.

(Fourth embodiment)

Although each of the second and third embodiments has been described above with respect to the example in which the patterns of the self-scanning light emission element array chips as many as two columns are formed on the same chip, an example of simplifying the chip by commonly using the self-scanning function in those self-scanning light emission element arrays by each light emission element array will now be described hereinbelow.

The self-scanning light emission element array chip in the embodiment will now be described hereinbelow with reference to FIG. 15. In the embodiment as well, by arranging a plurality of, for example, 56 recording element array chips in the longitudinal direction, a print head corresponding to the longitudinal direction of the recording medium is realized.

The light emission element chips and their driving method which are used in the embodiment will now be described with reference to FIGS. 15 to 17.

Figure 15:
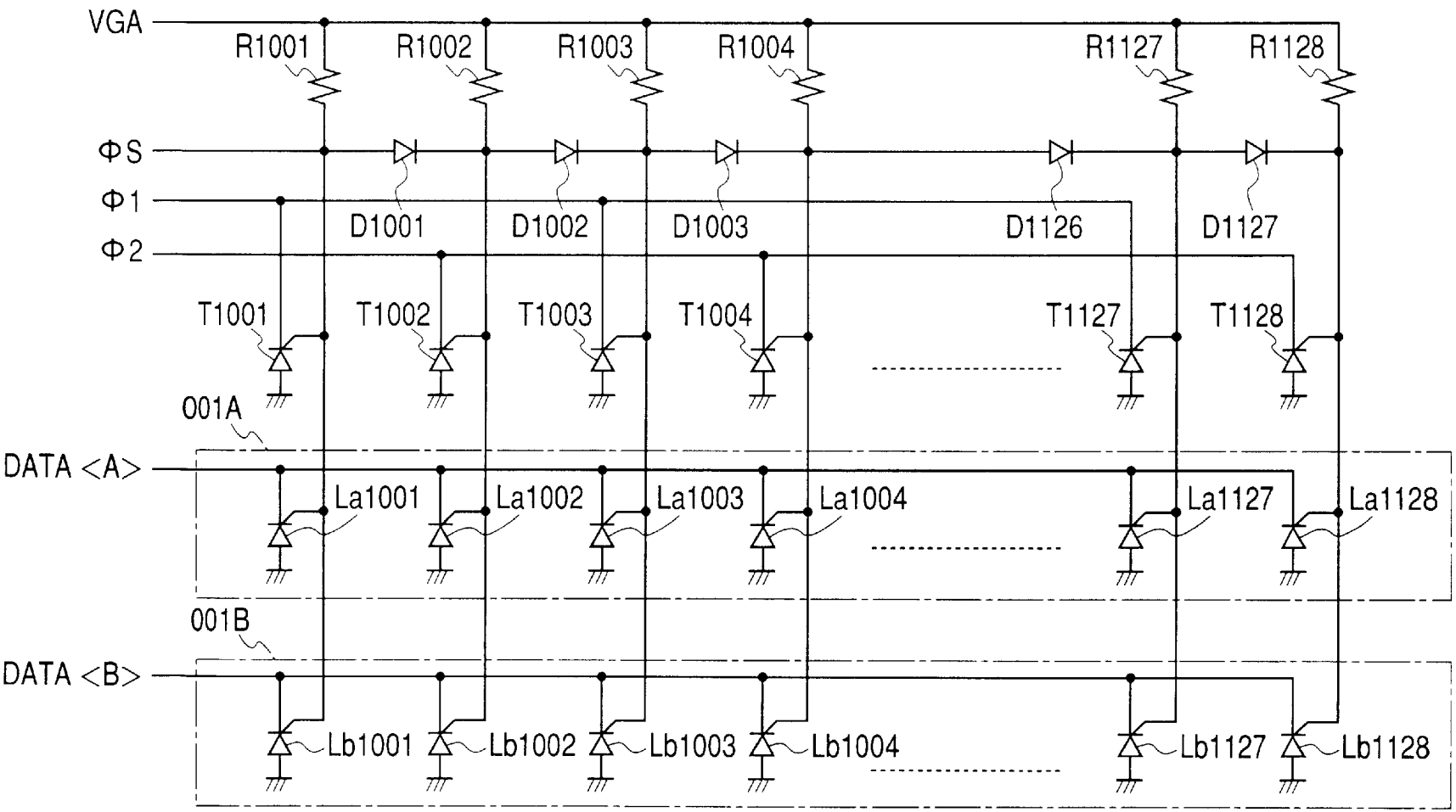
FIG. 15 is a diagram showing an equivalent circuit of a self-scanning light emission element array chip in the fourth embodiment.

FIG. 15 shows an equivalent circuit of one of the self-scanning light emission element array chips having the thyristor structure of the embodiment. The operation principle of the light emission element arrays and its control will now be described hereinbelow.

FIG. 15 shows the inside of one self-scanning light emission element array chip. However, the other chips also have substantially the same structure. Light emission element arrays 001A and 001B of two columns are provided in the self-scanning light emission element array chip. Each light emission element array has, for example, 128 light emission thyristors serving as light emission elements. It is sufficient that the number of light emission thyristors is equal to or larger than 2. La1001, La1002, . . . , and La1128 denote light emission thyristors of the light emission element array 001A of the first column. Lb1001, Lb1002, . . . , and Lb1128 indicate light emission thyristors of the light emission element array 001B of the second column. R1001, R1002, . . . , and R1128 denote load resistors. D1001, D1002, . . . , and D1128 indicate diodes. T1001, T1002, . . . , and T1128 show switching elements comprising the light emission thyristors. VGA denotes the power source supply line; ϕS start pulse line; and DATA<A> and DATA<B> image data lines each for supplying the image data to the light emission thyristor of each light emission element array. Now, paying attention to one switching element T1001, a gate terminal of the switching element T1001 is commonly connected to gate terminals of the light emission thyristors La1001 and Lb1001. That is, one switching element turns on two light emission elements.

For example, gate terminals of the switching elements T1001 and T1002 are mutually connected through the diode D1001 and are connected to the power source VGA through the load resistors R1001 and R1002, respectively. The transfer clocks ϕ1 and ϕ2 for the transferring operation are respectively supplied to cathodes of the switching elements T1001 and T1002.

The light emitting operation of the self-scanning light emission element array chip in the embodiment will now be described as an example with reference to FIGS. 15 and 17.

Figure 17:
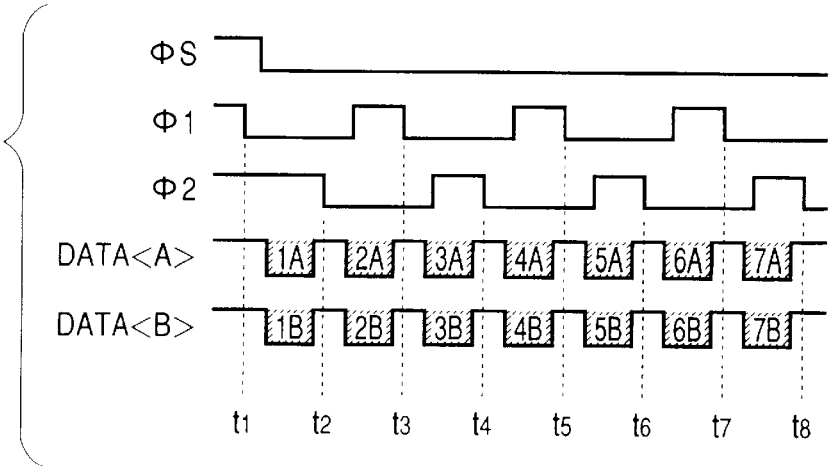
FIG. 17 is an explanatory diagram of a control unit in the fourth embodiment.

FIG. 17 shows time of each signal and a state of a pulse in the case where the pulse widths of write signals which are supplied to the light emission element arrays are almost equal.

At time t1 in FIG. 17, now assuming that one T1001 of the switching elements is turned on by the transfer clock ϕ1, its gate potential is almost equal to zero volt and this potential exerts an influence on the right direction through the diode D1001. When the timing reaches time t2, only the elements in the right direction are selectively turned on by the next transfer clock ϕ2, so that the data can be transferred to the right. When the thyristor T1001 is addressed for a time interval between t1 and t2, simultaneously with it, the DATA clock corresponding to the image data is supplied as a pulse displayed at 1 to DATA<A> and DATA<B> in FIG. 17 through write signal lines DATA<A> and DATA<B> in FIG. 15, so that the corresponding light emission thyristors La1001 and Lb1001 in which the gates are commonly used together with the selected thyristor T1001 simultaneously emit the light. In dependence on black and white of the given image data, the recording is not performed if each light emission element is turned off. Since the thyristor T1002 is addressed for a time interval between t2 and t3, the light emission thyristors La1002 and Lb1002 can be allowed to emit the light. By repeating the transferring operation and the on/off operations of the image data as mentioned above and inputting the image data, the light emission of a desired light emission thyristor can be performed in accordance with the image data which is inputted.

A control unit for generating each signal through each signal line which is supplied to a plurality of light emission element chips in the exposing apparatus will now be described with reference to FIG. 16.

Figure 16:
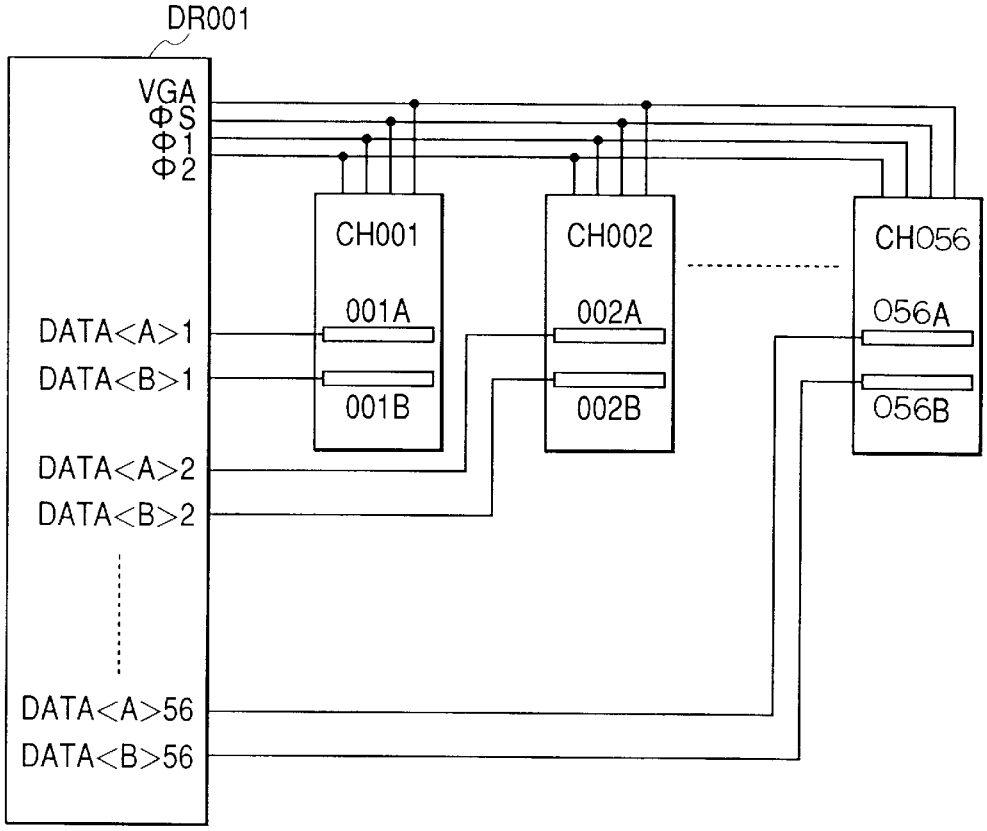
FIG. 16 is a time chart of each signal in the fourth embodiment.

In FIG. 16, CH001, CH002, . . . , and CH056 denote recording chips constructed as self-scanning light emission element array chips and DR001 indicates a driver unit for controlling the light emitting operation of the exposing apparatus. Although an exposing apparatus in which a light emission element chip array is formed by arranging 56 recording chips will now be described as an example, the number of recording chips can be arbitrarily set to any value so long as it is equal to or larger than 1. The signals of VGA, $\phi$S, $\phi$1, and $\phi$2 are commonly supplied to the recording chips CH001, CH002, . . . , and CH056. Since the write signal line is connected to each of columns A and B of each recording chip, image data lines of DATA<A>1 and DATA<B>1 are connected to the light emission element arrays 001A and 001B in the recording chip CH001. Similarly, write signal lines of DATA<A>2 and DATA<B>2 are connected to light emission element arrays 002A and 002B in the recording chip CH002. By the above structure and the operation of the recording chip mentioned above, the light emission elements in the same address in each light emission element array in each recording chip can simultaneously perform the light emitting operation and the on/off operations of the light emission are controlled by each write signal.

It is assumed that each of the operations of the charging, development, transfer, and the like other than the exposing operation by the light emission elements is executed in a manner similar to the foregoing embodiments.

According to the fourth embodiment as mentioned above, the image recording of a high speed and high resolution can be realized by the recording element arrays of a plurality of columns and since the transfer function of each recording element array is commonly used, small and simple recording chips, recording head, and image recording apparatus can be realized.

In the above embodiments, the print head having the recording element arrays of two columns has been described as an example of the print head having a plurality of recording element arrays. However, the invention can be also applied to a print head having recording element arrays of three or more columns.

In this instance, by connecting a plurality of recording elements to one switching element, the recording elements of a plurality of columns can be simultaneously scanned.

In the above embodiments, the example of forming the electrostatic latent image onto the image holding material by using the optical print head in which the light emission elements are arranged in an array shape as recording elements has been described. However, the invention can be also obviously applied to other examples using various recording elements such as thermal print head in which heat generating elements are arranged in an array shape, ink jet head, and the like.

Although the present invention has been described above with respect to the several preferred embodiments, the invention is not limited to the foregoing embodiments but many modifications and variations are possible within the spirit and scope of the appended claims of the invention.

What is claimed is:

1. A recording chip comprising:

a plurality of recording element arrays arranged approximately in parallel; and a switching element array for sequentially turning on adjacent switching elements, switching elements in said switching element array being connected to the plurality of recording elements respectively included in said different recording element arrays, wherein the plurality of switching elements in said switching element array are sequentially turned on, so as to simultaneously scan said plurality of recording element arrays.

2. A recording chip according to claim 1, wherein said plurality of switching elements are sequentially turned on by pulse signals of two phases.

3. A recording chip according to claim 1, wherein said recording element is a light emission element.

4. A recording chip according to claim 1, wherein said switching element includes a thyristor structure.

5. A recording chip according to claim 4, wherein said recording element includes a thyristor structure.

6. A recording chip according to claim 5, wherein a gate of said switching element is connected to a gate of said recording element.

7. A recording chip according to claim 6, wherein one end other than the gate of said switching element is connected to a shift signal line.

8. A recording chip according to claim 7, wherein one end other than the gate of said switching element is connected to either one of the two shift signal lines.

9. A recording chip according to claim 7, wherein one end other than the gate of said switching element is connected to an image signal line.

10. A recording head comprising:

input means for inputting an image signal; and a plurality of recording element chips, each comprising, a plurality of recording element arrays arranged approximately in parallel, and subjected to recording control in response to the input image signal, and a switching element array for sequentially turning on adjacent switching elements, switching elements in said switching element array being connected to the plurality of recording elements respectively included in said different recording element arrays, wherein the plurality of switching elements in said switching element array are sequentially turned on, so as to simultaneously scan said plurality of recording element arrays.

11. A recording head according to claim 10, wherein said plurality of switching elements are sequentially turned on by pulse signals of two phases.

12. A recording head according to claim 10, wherein said recording element is a light emission element.

13. A recording head according to claim 10, wherein said switching element includes a thyristor structure.

14. A recording head according to claim 13, wherein said recording element includes a thyristor structure.

15. A recording head according to claim 14, wherein a gate of said switching element is connected to a gate of said recording element.

16. A recording head according to claim 15, wherein one end other than the gate of said switching element is connected to a shift signal line.

17. A recording head according to claim 16, wherein one end other than the gate of said switching element is connected to either one of the two shift signal lines.

18. A recording head according to claim 16, wherein one end other than the gate of said switching element is connected to an image signal line.

19. An image forming apparatus comprising:

an image supporting body;

input means for inputting an image signal; and a plurality of recording element chips, each comprising, a plurality of recording element arrays arranged approximately in parallel, and subjected to recording control in response to the input image signal, and a switching element array for sequentially turning on adjacent switching elements, switching elements in said switching element array being connected to the plurality of recording elements respectively included in said different recording element arrays, wherein the plurality of switching elements in said switching element array are sequentially turned on, so as to simultaneously scan said plurality of recording element arrays, and an image is formed on said image supporting body.

20. An apparatus according to claim 19, wherein said switching elements are sequentially turned on by pulse signals of two phases.

21. An apparatus according to claim 19, wherein said recording element is a light emission element.

22. An apparatus according to claim 21, wherein said recording medium is a photosensitive material, and further comprising:

developing means for developing an image recorded on said photosensitive material; and transfer means for transferring the image developed by said developing means onto a recording paper.

23. An apparatus according to claim 19, wherein said switching element includes a thyristor structure.

24. An apparatus according to claim 23, wherein said recording element includes a thyristor structure.

25. An apparatus according to claim 24, wherein a gate of said switching element is connected to a gate of said recording element.

26. An apparatus according to claim 25, wherein one end other than the gate of said switching element is connected to a shift signal line.

27. An apparatus according to claim 26, wherein one end other than the gate of said switching element is connected to either one of the two shift signal lines.

28. An apparatus according to claim 25, wherein one end other than the gate of said switching element is connected to an image signal line.

* * * * *